US010363190B2

(12) United States Patent
Elias

(10) Patent No.: US 10,363,190 B2
(45) Date of Patent: Jul. 30, 2019

(54) ATTACHMENT DEVICE FOR A SURGICAL LIMB SUPPORT

(71) Applicant: Christopher Ian Elias, Hamilton (NZ)

(72) Inventor: Christopher Ian Elias, Hamilton (NZ)

( * ) Notice: Subject to any disclaimer, the term of this patent is extended or adjusted under 35 U.S.C. 154(b) by 0 days.

(21) Appl. No.: 15/564,631

(22) PCT Filed: Apr. 2, 2015

(86) PCT No.: PCT/NZ2015/000021

§ 371 (c)(1),
(2) Date: Oct. 5, 2017

(87) PCT Pub. No.: WO2015/152733

PCT Pub. Date: Oct. 8, 2015

(65) Prior Publication Data

US 2018/0085270 A1 Mar. 29, 2018

(30) Foreign Application Priority Data

Apr. 4, 2014 (NZ) ..... 623485

(51) Int. Cl.
*A61G 13/10* (2006.01)
*A61G 7/075* (2006.01)
*A61G 13/12* (2006.01)

(52) U.S. Cl.
CPC ..... *A61G 13/101* (2013.01); *A61G 7/075* (2013.01); *A61G 13/1235* (2013.01); *A61G 13/1245* (2013.01)

(58) Field of Classification Search
CPC ..... A61G 13/101; A61G 2007/0519; A61G 13/1235; A47B 23/02; A47B 23/025
USPC ..... 108/143, 49, 9
See application file for complete search history.

(56) References Cited

U.S. PATENT DOCUMENTS 393,649 A * 11/1888 Kirkpatrick ..... A47B 17/02 108/3
866,522 A * 9/1907 Scanlon ..... A47B 23/02 248/289.11
1,043,638 A * 11/1912 Sneed ..... A47B 23/02 108/140
1,386,151 A * 8/1921 Brewer ..... A47B 23/02 108/5
1,431,299 A * 10/1922 Godsell ..... A47D 7/04 5/308

(Continued)

OTHER PUBLICATIONS

International Search Report and Written Opinion of the International Searching Authority for PCT/NZ2015/000021 dated Jul. 2015 (20 pages).

*Primary Examiner* — Eric J Kurilla
*Assistant Examiner* — Amanda L Bailey
(74) *Attorney, Agent, or Firm* — Greer, Burns & Crain, Ltd.

(57) ABSTRACT

A limb support system for an operating table or hospital bed is provided and includes an adjustable member configured to be connected to a limb support associated with an operating table or hospital bed, where, in use, the system is configured to allow the adjustment member and an attached limb support to extend outwardly from the operating table or hospital bed when required, and allow the adjustment member and the limb support to be located under the operating table or hospital bed when not required.

17 Claims, 7 Drawing Sheets

(56) References Cited

U.S. PATENT DOCUMENTS

| | | | | | |
|---|---|---|---|---|---|
| 1,460,306 | A * | 6/1923 | Anderson | A47B 23/02 108/141 |
| 1,662,675 | A * | 3/1928 | Innes | A47B 23/02 108/5 |
| 2,460,244 | A * | 1/1949 | Strauss | A47B 23/02 108/137 |
| 2,535,112 | A * | 12/1950 | Woody | A47B 23/02 108/49 |
| 2,692,806 | A * | 10/1954 | Grace | A47B 23/02 108/143 |
| 3,145,965 | A * | 8/1964 | Stein | A47B 91/02 248/188.5 |
| 3,543,312 | A * | 12/1970 | Pofferi | A47B 23/02 108/49 |
| 6,336,412 | B2 | 1/2002 | Heimbrock et al. | |
| 6,471,167 | B1 * | 10/2002 | Myers | A61G 13/101 248/125.9 |
| 7,042,337 | B2 | 5/2006 | Borders et al. | |
| 8,286,283 | B2 | 10/2012 | Copeland et al. | |
| 2004/0133979 | A1 | 7/2004 | Newkirk et al. | |
| 2008/0034502 | A1 * | 2/2008 | Copeland | A61G 13/12 5/621 |
| 2010/0192302 | A1 | 8/2010 | Di Lauro et al. | |

* cited by examiner

ATTACHMENT DEVICE FOR A SURGICAL LIMB SUPPORT

BACKGROUND

The present invention relates generally to an attachment device for a surgical limb support. In particular, the present invention relates to an attachment device for positioning a surgical limb support in relation to an operating table, or the like.

Tables used for surgery or examination of a patient are known as operating tables, and provide a support surface for a patient to lie on during a procedure. Typically the support surface is slightly longer and slightly wider than a human body. Many operating tables have two or three sections along their length that can pivot at the connections between them, to provide for supporting a patient's body at different positions.

An operating table is about as wide as an adult torso. Therefore, limb supports (most typically arm supports) which extend out from the operating table are used to support the arms in any desired position, for example from parallel to perpendicular to the torso. These limb supports are needed for any operation on whatever part of the body. For operations on arms and hands, the arm board is removed and a wider 'table' is attached, with a support extending down to the floor, to give rigidity.

Limb supports usually take the form of a connection portion configured to attach to the side rail of an operating table, and a limb support typically in the form of a padded board connected at one end to the connection portion.

A representative limb support used in the industry is depicted in FIG. 6, which exemplifies a typical connection system to a side rail of an operating table. The operating table 100 comprises a rail 101 extending along the side thereof. A surgical limb support 102 is mounted to the rail 101 using a female connection portion 103. The inner profile of the female connection portion 103 corresponds to the outer profile of the rail 101. To mount the limb support 102 on the rail 101, the connection portion 103 is fitted around the rail and clamped into position. Sometimes, the connection mechanism can include a clamp to allow for fastening. However, in many cases, the female portion is simply configured to slid along the rail. This is convenient to allow for situations when the patient is slid down the operating table to position the legs in stirrups. In such a case, the limb supports can be slid down the rail to support the patient's arms.

Chinese Utility Model No. 201320013500 provides an option for supporting a patent's arm. This utility model relates to an arm support having a bracket that can be fixed with a bolt onto the side rail of an operating table, an extendible vertical support extending upwards from the bracket, and an arc shaped arm support mounted on the vertical support.

Limb supports (typically the arm supports) are removed from the table whenever a patient is to be transferred from their bed to the operating table at the start of the procedure, and from the operating table to their bed at the end of the procedure, so that bed and table are in very close approximation. This is important to ensure patient safety during the transfer process. Arm supports are also detached during some procedures e.g. laparoscopy. This detaching and re-attaching is repeated many times a day in an operating room.

These limb supports are also disconnected from the operating table when not in use.

The limb supports can be difficult to handle being relatively heavy and bulky.

This process can be inconvenient and time consuming. This delay may be particularly disadvantageous when the patient is in a critical state or it is otherwise important or convenient to begin operating on the patient with minimal delay.

Furthermore, this repetitive disconnection and re-connection increases the chance of:

- Accidental faulty re-attachment such that they become loose during use (such as during an operation);
- hazard to hospital staff if dropped or tripped over and/or to patients if the limb support becomes disconnected during use.

It should also be appreciated that surgical suites are often under huge demand and backlog, as hospitals must closely manage costs with expensive equipment, floor space and man-hours. As such, any improvements in relation to improved processes, equipment and safety in a surgical suite offers substantial health, social, and commercial benefits.

SUMMARY

It is an object of the invention to provide an improved limb support or device for supporting a limb support for an operating table, that addresses any one or more of the disadvantages of the prior art.

Alternatively, it is an object of the invention to at least provide the public with a useful choice.

Preferred aspects of the invention are set forth in the appended claims. Particular embodiments are described in non-limiting terms below.

According to a first aspect of the present invention there is provided a limb support system for an operating table or hospital bed, the limb support system including an adjustable member configured to be able to adjustably connect a limb support to the operating table or hospital bed, characterised in that, in use, the system is configured to allow the adjustment member and an attached limb support to extend outwardly from the operating table or hospital bed when required for use, and is also configured to allow the attached limb support to be substantially located under the operating table or hospital bed when not required.

In its broadest sense, the present invention allows attachment of a limb support to an operating table or patient bed in such a way that it can be quickly and easily moved between a use position and a non-use (storage) position under the operating table without dis-attachment and complete removal of the limb support, which previously was the status quo. The broad concept may be achieved through a number of configurations which are encompassed by the present invention, although a particularly preferred embodiment is described further below.

According to a further aspect of the present invention there is provided an attachment device for use with a limb support for supporting a patient's limb adjacent to a support surface of an operating table or hospital bed, the attachment device including:

1) an elongate support member having a first attachment portion at an upper end thereof configured to releasably attach the elongate support member to an operating table or hospital bed; and
2) an adjustment member including:
   a first portion configured to allow movable engagement of the adjustment member both rotationally and along the elongate length of the elongate support member; and a second attachment portion configured to be able to attach to the limb support;

wherein the attachment device is configured to provide at least two positions of the adjustment member, including a:

a use position, wherein the adjustment member is positioned at the upper end of the elongate support member, and the second attachment portion of the adjustment member is facing in a substantially opposing direction to the first attachment portion of the elongate support member; and a non-use position, wherein the adjustment component is positioned distal from the upper end of the elongate support member, and the second attachment portion of the adjustment member is facing generally towards the first attachment portion of the elongate support member.

According to a further aspect of the present invention there is provided an operating table or hospital bed or the like which includes an attachment device or limb support system as described herein.

According to a further aspect of the present invention there is provided a method of using an attachment device as described herein, wherein the method includes:

a) attaching the attachment device to a portion of a hospital bed, operating table or the like via the first attachment portion;

b) attaching a limb support to the attachment device via the second attachment portion;

c) moving the adjustment member to the use position when required to support a limb of a patient adjacent to the hospital bed, operating table or the like; and d) moving the adjustment member to the non-use position when not required to support a limb of patient, such that the limb support is oriented and positioned under the hospital bed, operating table or the like.

Using the attachment device in the use position and when the limb support is attached, the limb support will be configured (as a result of the orientation and position of the adjustment member) to extend outwards from the external circumference of the support surface of the hospital bed such that a patient's arm or leg may rest on it, as similar to prior art limb supports.

However, for a non-use position, one may quickly and easily adjust the adjustment member by sliding it along the elongate support member, and rotating it upon the support member such that the second attachment portion is substantially facing in an inwards orientation towards and under the hospital bed such that the entire limb support and much of the attachment device (particularly the second attachment portion) are conveniently positioned. When required for use again, the opposite movement may be made to result in the attachment device being placed back in the use position.

The invention reduces the set up time required when a patient's limb needs to be supported adjacent to the support surface of an operating table where the patient's body lies. The limb support, conveniently connected to an operating table, may then easily be rotated out from non-use position underneath the operating table, and raised upwards into a use position adjacent and usually to the same horizontal plane of the support surface of the operating table for a desirable placement of the patient's limb, whether it be a leg or an arm.

The invention also avoids repetitive attachment and removal. Efficiency in surgical suites cannot be underestimated, as previously noted.

Additionally, the invention is particularly advantageous because it still allows a patient to be placed on or taken off the operating table and on to an adjacent hospital bed (typically on wheels) without the limb support obstructing the transfer. This is because, in the non-use position, the attachment device only protrudes from a side rail of an operating table by an insignificant distance (in preferred embodiments, this protrusion may be minimised to about 1 cm or less), allowing a patient's bed or stretcher to be moved very close alongside the operating table to allow for a quick transfer of the patient between operating table and a subsequent bed. This process is performed commonly in an operating room, so the ability to still provide this functionality is important.

Also, because the invention avoids the need to remove the limb support from the operating table, it prevents safety concerns previously discussed, such as accidental dropping, incorrect fitting and so forth.

Additional advantages will become clear with the ensuing description of the preferred features of the invention.

Attachment Device

Throughout this specification, the term attachment device should be considered any component, mechanism or system which is configured to connect first to at least one part of a hospital bed or the like, and connect second to a limb support.

First, it should be appreciated that the limb support system may be embodied by an attachment device used to retrofit and be used with existing limb supports for an operating table. Alternatively, the limb support system includes both the attachment device together with one or more limb supports (either able to be removable, or permanently fixed together).

Preferably, the attachment device is configured to be retrofitted to an existing limb support.

This is considered to be particularly commercially viable considering essentially all hospitals will have limb supports already. Therefore, this solution makes adaptation to a new system easier from a management, financial and safety perspective. The limb supports themselves do not form an essential part of the invention. However, it should be appreciated that the attachment device may be manufactured and sold with or without one or more limb supports.

According to a further aspect of the invention there is provided a kitset which includes the attachment device as described herein and at least one limb support. The limb supports may include any number of an arm or leg supports. This may be ideal for hospitals that either do not already have existing limb supports, or need replacement of limb supports. Equally, when new hospitals or surgical suites within, are being developed, the entire system may be purchased for convenience.

Elongate Support Member

Throughout this specification, the term elongate support member should be taken as meaning a component that is configured, in use, to allow movement of the adjustment member along its elongate length, and also rotationally about its elongate length. In use, the elongate support member typically will be mounted to a side or end rail of a hospital bed, and wherein the elongate support member will extend in a substantially vertical orientation, essentially perpendicular to the side or end rail. In this way, the elongate support member will be positioned to allow for height adjustment of the adjustment member upon the elongate support member.

Preferably, the elongate support member is configured to have a substantially circular cross section.

The circular cross-section provides one convenient option to allow the adjustment member to rotate around its cross section, as will be discussed further. A further advantage of the circular cross section is that it does not have any sharp edges which will be exposed, thus avoiding injury to either the patient or surgical staff, and/or damage to equipment.

Throughout this specification, the term first attachment portion should be taken as meaning any component on the elongate support which is configured member which is configured to engage with a portion of a hospital bed or the like.

Preferably, the first attachment portion is configured to attach to a side rail or an end rail of the hospital bed.

Many operating tables have side rails in shape of a flat stainless steel bar running along the sides for mounting of equipment thereon. It is therefore advantageous for the attachment device to be configured to attach to a part of this rail.

Preferably, the first attachment portion is in the shape of a female cut out corresponding to the male shape of the side rail.

The matching female shape of first attachment portion and the male shape of the side rail increases the ease with which the support member can be attached to the side rail, and enables a particularly secure fit.

The female shape importantly engages with the side rail or end rail, but also cleverly minimises the protrusion of the elongate support member from bed's external circumference, which is an important advantage when the attachment device is in the non-use position. This is exemplified in FIG. 4.

More preferably, the first attachment portion is configured to clamp to the side rail.

Clamping to the side rail further increases the rigidity and support provided to the limb support, and reduces the chance that the limb support will be moved unintentionally during use. Regardless of whether a clamp is used or not, it should be appreciated that the present invention may allow for the attachment device to be easily slid along a rail on the operating table if so desired (for example if the patient is slid down the operating table to position its legs in stirrups).

Optionally, the female cut out in the elongate support member may be provided in a bracket attached to the elongate support member.

Such an embodiment may provide more flexibility for the types of suitable clamping mechanisms that clamp the attachment device onto the side rail.

Preferably, the elongate support member includes at least one stop located below the first attachment portion.

The stop may act as a barrier to prevent the adjustment member from moving beyond it. The stop therefore may prevent the adjustment member from simply falling off the attachment device. Additionally, the stop may provide a pre-determined "non-use" height for the adjustment member, which as one can appreciate will be located at a position which allows the attachment device (and the limb support) to then be swung into a position under the support surface of the hospital bed or the like.

Preferably, the elongate support member includes an in use locking mechanism.

The locking mechanism allows the adjustment member to be held at a predetermined height on the elongate member to provide at least one in use position. It should be appreciated that a wide variety of locking mechanisms may be used with the present invention, including releasable snap-fit locks, tensioning locks, and so forth.

Preferably, the locking mechanism is a wedge shaped press-in tab biased to a position to releasably support the adjustment member in a position corresponding to the in use position.

In this way, one may quickly raise the adjustment member with one hand and lock it quickly into the use position without difficulty.

It should be appreciated that the locking mechanism may also provide the ability to lock the rotational movement of the adjustment member at one or more pre-determined use positions, or may optionally allow rotational movement of the adjustment member at the use position. Either option may be useful if the surgical team wishes to position the horizontal orientation of the limb support.

Also, the adjustment mechanism may include the ability to adjust the angle of the limb support extending therefrom, departing from the horizontal plane if so desired. In some embodiments this may be provided by a pivotal connection with pre-set angles, or comprise a ratchet mechanism by which the limb support may be raised to any angle easily and then support itself in that position.

This may be useful if the surgical team needs to position the limb at an upwards or downwards angle extending from the hospital bed.

In an alternative embodiment, the locking mechanism may actually be provided by the adjustment member, which may be tensioned upon the elongate member at a desired height and rotational orientation. This will be discussed in further detail below with regards to the adjustment member.

Adjustment Member

Throughout this specification, the term adjustment member should be taken as meaning any component on the attachment device that allows for movement of the second attachment portion, as to allow positioning of a limb support a desired position, both in the use and non-use positions.

Preferably, the first portion of the adjustment member is a collar configured to slidably engage around the elongate support member.

This may enable easy movement of the adjustment member on the elongate support member while providing sufficient support for a limb support connected to the adjustment member. This arrangement may also simplify manufacture and assembly, reducing the cost of the device.

Preferably, the collar is a complete ring.

Therefore in one preferred option, the collar may be placed into the in use position by passing it over a wedge shaped locking mechanism, as depicted in FIGS. 1-3.

Alternatively, the collar is an incomplete ring.

In this embodiment, the inventor envisages the gap within the ring may allow one to guide the gap in line with a protrusion in the elongate support member (acting as an alternative in use locking mechanism), and then swivel the collar to lock the adjustment member into a horizontal position for use.

In one embodiment already eluded to, the collar may be configured to be tensioned against the surface of the elongate support member.

For instance, a tensioning screw may pass radially inward through the collar to be tightened into the surface of, or perhaps a groove formed in, the elongate support member.

The simplicity of this option allows the collar to be supported at any height and at any angle. It also conveniently enables the attachment device to be used on different operating tables and/or with different limb supports with varying dimensions—e.g. the collar may be moved to any height to accommodate limb supports of different thicknesses.

The attachment device may be formed from stainless steel. Stainless steel is a material particularly suited for use in an operating theatre or similar environment. Other suitable materials such as plastic materials having sufficient rigidity and strength to support a surgical limb support in use.

The inventor acknowledges that it would be ideal to design the adjustable member to be removable from the elongate member to allow for cleaning, replacement or maintenance.

Second Attachment Portion

Throughout this specification, the term second attachment portion should be taken as meaning any component on the attachment device that is configured to engage with a limb support.

Preferably, the second attachment portion is configured to replicate a profile of a side support rail of a hospital bed or the like. For instance, this is exemplified in FIG. 3.

This is particularly advantageous in the context of retrofitting because it allows the limb support, which would normally engage with the support rail, to simply engage instead with the second attachment portion of the adjustment member.

Clearly, the second attachment portion may be configured in a wide number of alternatives to suit corresponding engagement profiles on other existing limb supports. The inventor foresees that in the event the limb support system is manufactured and sold with detachable limb supports, in which case the attachment portion may be configured as so desired.

In the event the limb support system is manufactured to include a permanently fixed limb support connected to the attachment device, then the second attachment portion may simply be a rigid connection, or may also be an adjustable pivot point.

Limb Support

Throughout this specification, the term limb support should be taken as meaning any object which is configured to retain, hold or position a patient's limb (i.e arm or leg) adjacent to, extending from, or beside a support surface of an operating table, hospital bed or the like.

It should be appreciated that the hospital bed and/or the limb support do not form part of the inventive concept relating to the attachment device, but may be manufactured, sold and/or used together with either both the hospital bed and/or one or more limb supports.

In most circumstances the limb support will be an arm support, which are used regularly in the operating room, for any operation or procedure. A typical limb support has a rigid elongate base, with a padded top surface for comfort to the patient's arm. A wide range of dimensions and features of limb supports are available and are used, for instance a concave top surface, arm restraints, or swivelling mechanisms. Any such features of the limb supports may also be used in conjunction with the present invention.

Method of Use

Preferably, the method is used for an operating table.

It should be appreciated that the present invention has particularly applicability to an operating room, where the operating table requires limb supports to safely hold the patient's limb during an operation or procedure. Limb supports are most commonly used for each arm, wherein the patient's arms extend out laterally from the main support surface of the operating table. However, it should be appreciated that the method may also be used for a wide number of bed like structures and alternative uses without departing from the scope and spirit of the invention.

Preferably, step a) includes attaching the attachment device to a side railing of an operating table.

This embodiment relates primarily to the use of an arm support. On an operating table, the support surface (and accompanying side railings) are normally divided into sections reflecting normal physiological body sized—a head portion, a torso portion, and a leg portion (which may divided into two sections at the area of the knees). For the arm supports, the attachment device would naturally be attached to the side railings on either one or both sides the torso section.

One will appreciate that if the limb support is a leg support, the attachment device may be attached at the side or base of the leg portion (the latter typically also includes a railing).

Preferably, step b) includes attaching an arm support to the second attachment portion of the attachment device.

Arm supports are well known. They typically have a padded cupped or flat surface configured to hold the patient's arm. The present invention advantageously is not limited to any particular type or configuration of limb supports, and may be retrofitted to, or connected to, a wide range of limb supports.

Preferably, step c) includes subsequently or simultaneously adjusting the angle of the adjustment member and/or limb support in either the horizontal and/or vertical plane.

In this way, one may position the limb support to desired position extending out from the support surface of the operating table for the use position. Typically, for an arm support, this will be in the substantially same horizontal plane as the support surface, angled at approximately 30-40° radially from the side of the operating to provide a natural placement of the patient's arm adjacent to the operating table.

However, the inventor acknowledges that in certain circumstances, different angles and positioning of the limb support may be desirable.

Preferably, step d) includes moving the adjustment member to a non-use position such that the second attachment portion is angled approximately 30-90° away from the orientation of the first attachment portion.

Most preferably, when attached to an operating table, the second attachment portion is about 10°-30° offset from the side railing, so as to retain the second attachment portion and the attached limb support just under the support surface of the operating table. This would equate to the second attachment portion facing about 60-80° away from the orientation of the first attachment portion.

In other words, when the attachment device is attached to a side rail of an operating table, the arm supports may be angled inwards underneath the support surface, but do not directly face each other to avoid clashing against one another (as would be the case as depicted in FIG. 4).

Alternatively, step d) includes moving the adjustment member to a non-use position such that the second attachment portion is facing in subsequently the same orientation of the first attachment portion.

This would result in a configuration similar to as exemplified in FIG. 4. To avoid a clash with an oppositely positioned arm support, one of the attachment devices may have an offset stop relative to the other attachment device, such that the relative height of the adjustment member (and subsequently the limb support) are different to allow a "layering" effect underneath the support surface of the operating bed.

The present invention may provide any one or more of the following advantages:

improved ease of use by saving time and effort in storing a limb support when not in use, or in repositioning the limb support ready for use;

the attachment device may be used to retrofit existing limb supports so as to avoid hospitals needing to replace their current limb supports;

insignificant profile extending out from the external circumference of the hospital bed when the attachment device is in the non-use position (important to allow convenient and safe transfer of patients from one bed surface to another—a process that occurs many times throughout the day in an operating room); and/or reduced frequency of loss or misplacement of a limb support; and/or avoidance of injury resulting from issues from prior art devices where surgical staff may drop the limb support (these are typically quite heavy), or someone tripping on a detached surgical limb support.

BRIEF DESCRIPTION OF THE FIGURES

The invention will now be described by way of example only and with reference to any one of the accompanying drawings in which.

DETAILED DESCRIPTION

Embodiments of the present invention will be described in relation to an attachment device for a surgical arm support to a surgical table. However, a person skilled in the art will appreciate it can be used in conjunction with a leg support or with other support surfaces such as a hospital bed upon which there is a side rail or other suitable attachment point for the device of the present invention.

Figure 1:
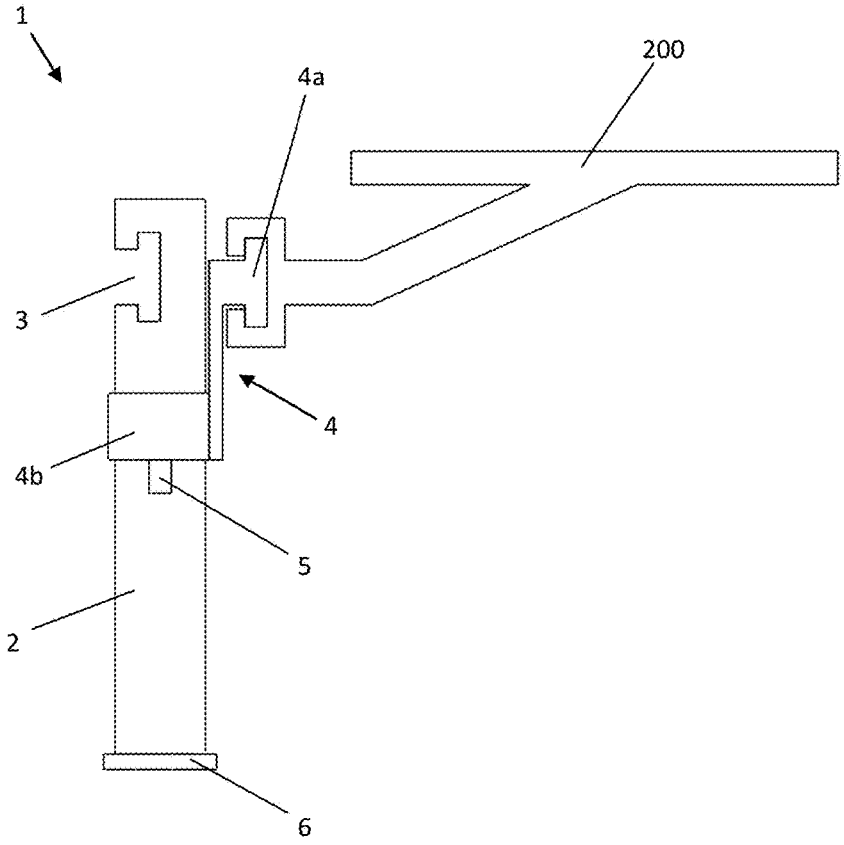
FIG. 1 shows a side view illustration of an attachment device for a surgical limb support in a preferred embodiment of the invention.

Referring to FIG. 1, an attachment device for a limb support is generally indicated by arrow 1. The attachment device 1 comprises an elongate support member made of stainless steel, in the form of a circular section support tube 2. This tube 2 may be hollow or solid without departing from the scope of the invention. The support tube 2 includes a stop 6 at a lower end thereof. The support tube 2 also includes a first attachment portion in the form of a female cut out 3 in the corresponding shape to a side rail of an operating table or bed, configured to engage with the side rail using a clamp (not shown). The female cut out 3 is positioned at an upper end of the support tube 2.

The attachment device 1 also includes a second attachment portion (generally indicated by arrow 4) which has a male portion 4*a* (with the same profile as a side rail portion) configured for attachment to a limb support 200. The second attachment portion 4 also includes a collar 4*b* which fits around the circular support tube 2 and can slide along a length of the circular support tube 2 between a "use" position (whereby the attached limb support 200 is raised on the support tube 2 such that the limb support 2 is adjacent and at a similar or substantially the same height as the support surface of the operating table, to support an arm of a patient lying on the support surface of the operating table) to a "non-use" position (whereby the attached limb support 200 is lowered on the support tube 2 and pivoted in an arc about the axis of the support tube 2 to a position substantially under the support surface of the operating table).

The clamping mechanism which secures the limb support 200 on the rail portion 4*a* may be of a known type, and is not shown in the Figures.

Figure 2:
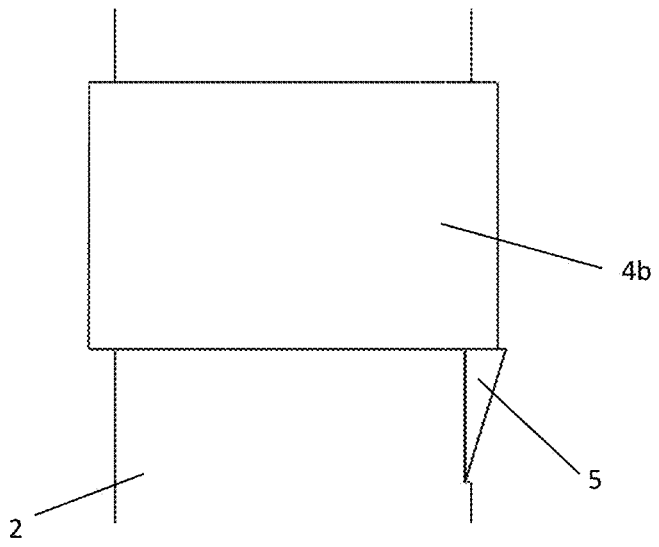
FIG. 2 shows a close-up side view illustration of the support for the second attachment portion as shown in FIG. 1.

FIG. 2 shows a close-up view illustration of the collar 4*b* of the second attachment portion 4 supported in its vertical use position on the support tube 2 via a press-in tab in the form of a wedge support 5 and which can be depressed by a user to allow the collar 4*b* to slide over it to move to the non-use position when the arm support is to be stored under the surgical table.

Figure 3:
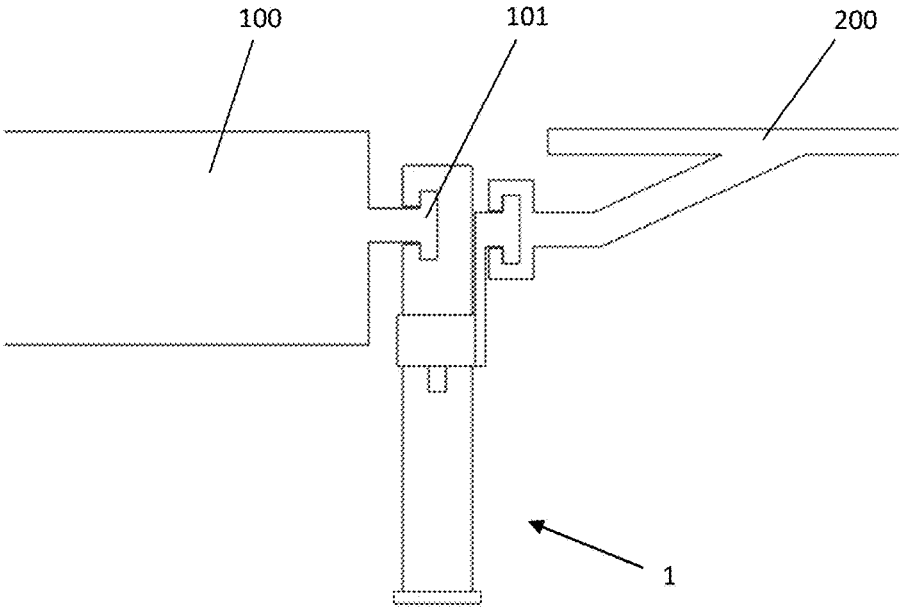
FIG. 3 shows a cross section view illustration of the attachment device of FIG. 1 mounted to an operating table in a use position.

FIG. 3 shows a cross section view of the attachment device 1 mounted to a rail 101 of an operating table 100 and supporting a limb support 200 in the "use" position. In the use position the limb support 200 is supported by device 1 alongside the operating table approximately the same height, to support a patient's arm.

Figure 4:
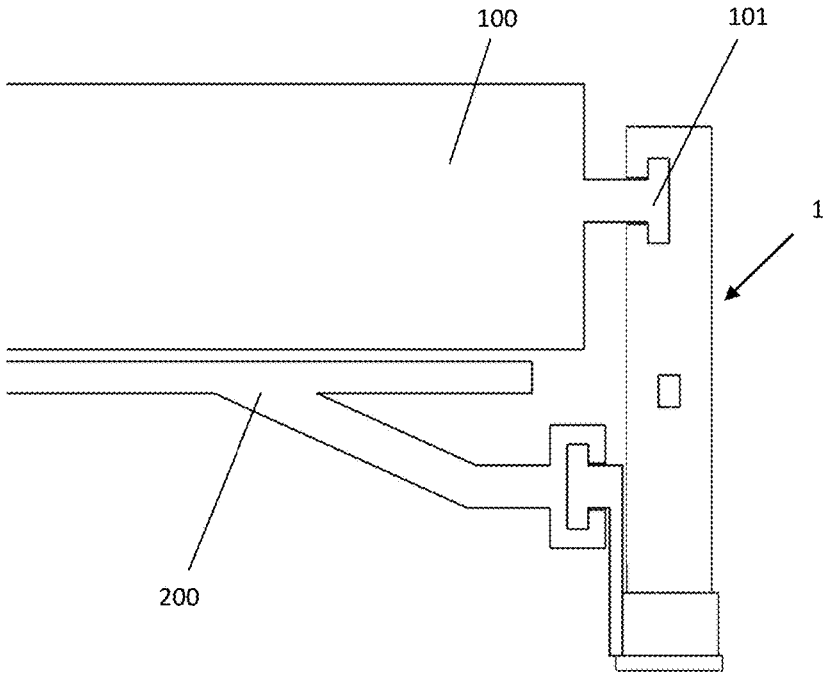
FIG. 4 shows a cross section view illustration of the attachment device of FIG. 1 mounted to an operating table in a non-use position.

FIG. 4 shows a cross section view of the same attachment device in the "non-use" position. In the non-use position the limb support 200 is supported underneath the operating table 100, to free up the space where the limb support 200 would have otherwise occupied.

Figure 5:
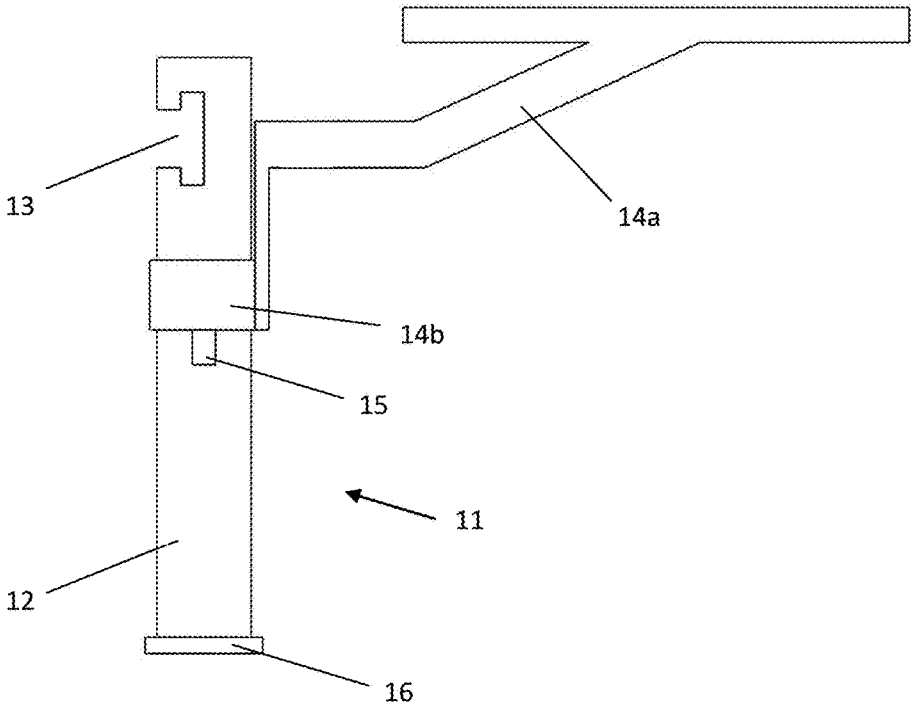
FIG. 5 shows a cross section view illustration of a surgical limb support according to an embodiment of the invention.

FIG. 5 shows a limb support 11 permanently connected to an attachment device 1 of the present invention. The limb support 11 includes an elongate support member 12, a first attachment portion in the form of a female cut out 13, a limb support portion 14*a* formed with a collar 14*b* for slideable and rotatable attachment to the elongate support member 12, a use locking mechanism 15 and a non-use position stop 16. While the limb support portion 14*a* is not separable from the collar 14*b*, the limb support portion 14*a* can be lowered and rotated to a position underneath the support surface of the operating table to quickly stow the limb support portion 14*a* without the need to disconnect it from the operating table.

Figure 6:
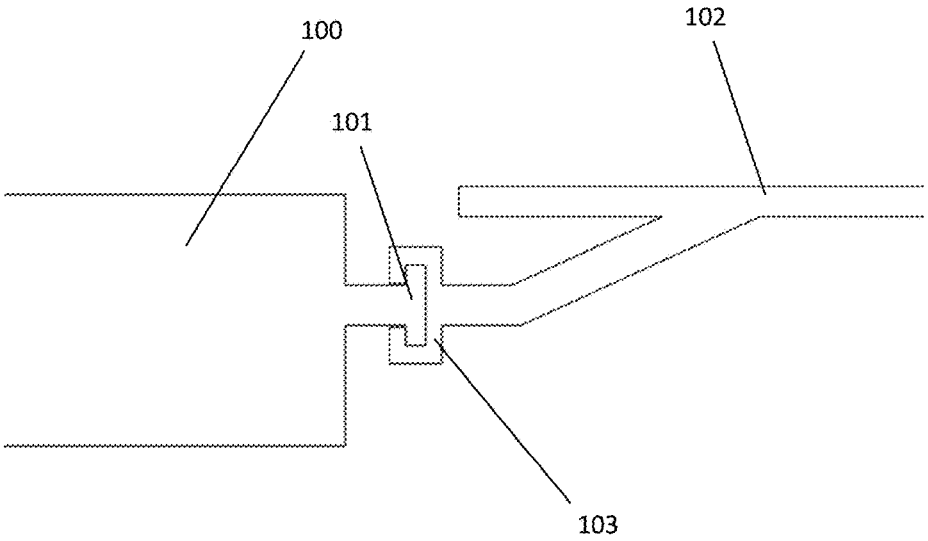
FIGURE 6 (PRIOR ART)
FIG. 6 shows a cross section view illustration of a prior art limb support mounted to an operating table.
Figure 7:
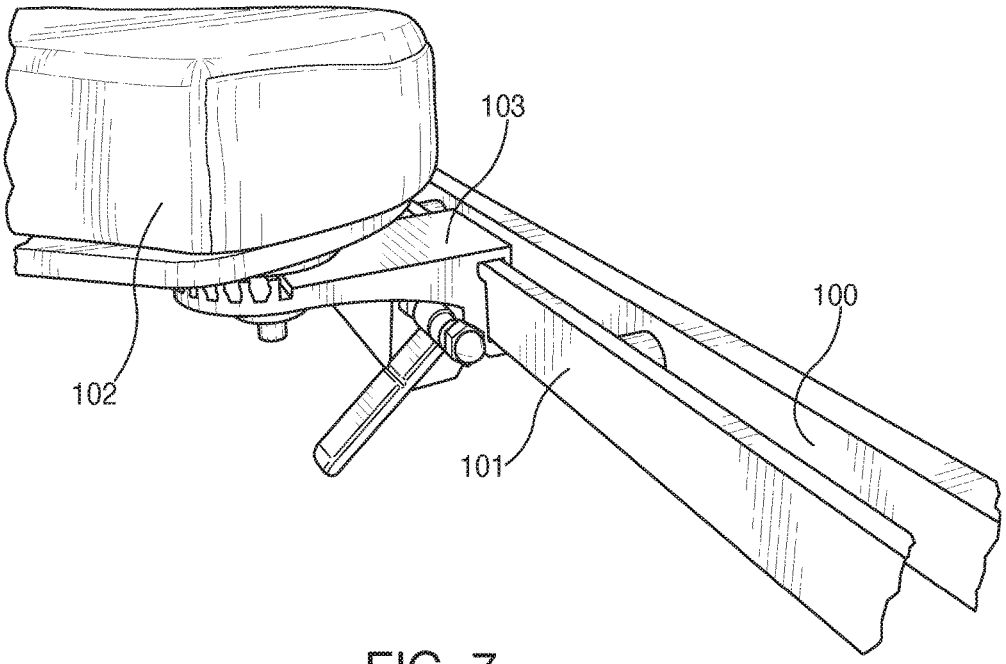
FIG. 7 (Prior Art)
FIG. 7 shows a photograph of a prior art limb support (arm support) mounted to an operating table.

FIGS. 6 and 7 illustrate a Prior Art support arm (102) that attaches directly to the rail (101) of a hospital bed (100) via a clamping attachment portion (103). The support art (102) is removed may times throughout a normal day in an operating room.

The invention may also be said broadly to consist in the parts, elements and features referred to or indicated in the specification of the application, individually or collectively, in any or all combinations of two or more of said parts, elements or features.

Where in the foregoing description reference has been made to integers or components having known equivalents thereof, those integers are herein incorporated as if individually set forth.

It should be noted that various changes and modifications to the presently preferred embodiments described herein will be apparent to those skilled in the art. Such changes and modifications may be made without departing from the spirit and scope of the invention and without diminishing its attendant advantages. It is therefore intended that such changes and modifications be included within the present invention.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Aspects of the present invention have been described by way of example only and it should be appreciated that modifications and additions may be made thereto without departing from the scope thereof as defined in the appended claims.

I claim:

1. An attachment device for use with a limb support for supporting a patient's limb adjacent to a support surface of an operating table, the attachment device comprising:

1) an elongate support member extending in a substantially vertical orientation, the elongate support member having a first attachment portion at an upper end thereof, the first attachment portion configured to releasably attach to a horizontal side rail of an operating table so that the elongate support member extends vertically below a support surface of the operating table; and 2) an adjustment member including:

a first portion configured to allow movable engagement of the adjustment member both rotationally and along the elongate support member; and a second attachment portion configured to attach the limb support to the attachment device, or wherein the adjustment member is integrally formed with the limb support;

wherein the attachment device is configured to provide at least two positions of the adjustment member, including:

a use position, wherein the adjustment member is positioned at the upper end of the elongate support member, to position the limb support outwards of and adjacent to the support surface of the operating table; and a non-use position, wherein the adjustment member is positioned distal from the upper end of the elongate support member and rotated on the elongate support member about a vertical axis such that the limb support is oriented and positioned under the support surface of the operating table.

2. The attachment device as claimed in claim 1, wherein the attachment device is configured to be retrofitted to an existing limb support.

3. The attachment device as claimed in claim 1, wherein the elongate support member is configured to have a substantially circular cross section.

4. The attachment device as claimed in claim 1, wherein the first attachment portion is in the shape of a female cut out corresponding to a male shape of the side rail.

5. The attachment device as claimed in claim 1, wherein the elongate support member includes at least one stop located below the first attachment portion.

6. The attachment device as claimed in claim 1, wherein the attachment device includes an in use locking mechanism to releasably support the adjustment member in a position corresponding to the in use position.

7. The attachment device as claimed in claim 6, wherein the locking mechanism is a wedge shaped press-in tab biased to a position to releasably support the adjustment member in the position corresponding to the in use position.

8. The attachment device as claimed in claim 1, wherein the first portion of the adjustment member is a collar configured to slidably engage around the elongate support member.

9. The attachment device as claimed in claim 8, wherein the collar is a complete ring.

10. The attachment device as claimed in claim 8, wherein the collar is an incomplete ring.

11. A method of using an attachment device to attach a limb support to an operating table, wherein the method includes:

a) attaching the attachment device to a horizontal side rail of the operating table via a first attachment portion at an upper end of an elongate support member of the attachment device so that the elongate support member extends substantially vertically to below a support surface of the operating table;

b) attaching a limb support to the attachment device via a second attachment portion;

c) moving the adjustment member to a use position at a top of the elongate support member when required to support a limb of a patient adjacent to the operating table; and d) moving the adjustment member distal from the upper end of the elongate support member and rotated about a vertical axis on the elongate support member to a non-use position when not required to support a limb of patient, such that the limb support is oriented and positioned under the operating table.

12. The method as claimed in claim 11, wherein step b) includes attaching an arm support to the second attachment portion of the attachment device.

13. The method as claimed in claim 11, wherein step c) includes subsequently or simultaneously adjusting the angle of the adjustment member and/or limb support in either the horizontal or vertical plane.

14. The method of as claimed in claim 11, wherein step d) includes moving the adjustment member to a non-use position such that the second attachment portion is angled approximately 45-90° away from the orientation of the first attachment portion.

15. The method of as claimed in claim 11, wherein step d) includes moving the adjustment member to a non-use position such that the second attachment portion is facing in subsequently the same orientation of the first attachment portion.

16. A kitset of parts, including an attachment device as claimed in claim 1, and at least one limb support.

17. An operating table including an attachment device as claimed in claim 1.

* * * * *